United States Patent [19]

Hackett et al.

[11] Patent Number: 4,754,262

[45] Date of Patent: Jun. 28, 1988

[54] MULTIPLEXED ALARM SYSTEM

[75] Inventors: Kenneth R. Hackett, Boulder; Alan R. Permut, Lafayette, both of Colo.

[73] Assignee: Interactive Technologies, Inc., St. Paul, Minn.

[21] Appl. No.: 894,098

[22] Filed: Aug. 8, 1986

Related U.S. Application Data

[63] Continuation of Ser. No. 585,103, Mar. 1, 1984, abandoned.

[51] Int. Cl.[4] ..... G08B 26/00

[52] U.S. Cl. ..... 340/525; 340/502; 340/505; 340/531; 340/825.14

[58] Field of Search ..... 340/525, 500, 502–508, 340/517, 518, 531, 825.06, 825.54, 825.07–825.1, 526, 527, 825.14, 870.16, 870.12, 870.13; 179/5 R, 5 P

[56] References Cited

U.S. PATENT DOCUMENTS

| | | | |
|---|---|---|---|
| 3,927,404 | 12/1975 | Cooper | 340/533 |
| 3,930,246 | 12/1975 | Campbell | 340/533 |
| 4,056,684 | 11/1977 | Lindstrom | 340/518 |
| 4,162,488 | 7/1979 | Silverman et al. | 340/505 |
| 4,203,096 | 5/1980 | Farley et al. | 340/538 |
| 4,228,424 | 10/1980 | Le Nay et al. | 340/518 |
| 4,367,458 | 1/1983 | Hackett | 340/539 |
| 4,392,125 | 7/1983 | Iwata | 340/505 |

*Primary Examiner*—Donnie L. Crosland
*Attorney, Agent, or Firm*—Charles E. Pfund

[57] ABSTRACT

A multiplexing method for an alarm system is disclosed in which a plurality of transponders connected in parallel by a pair of wires each monitors an opening and responds to a synchronizing signal after a preprogrammed time delay corresponding to the particular transponder if the opening it is monitoring is secured.

24 Claims, 3 Drawing Sheets

MULTIPLEXED ALARM SYSTEM

This is a File Wrapper continuation of co-pending application Ser. No. 585,103 filed on Mar. 1, 1984, now abandoned.

BACKGROUND OF THE INVENTION

This invention relates to security systems, in particular those that monitor whether an opening is opened or secured. A switch is maintained at each opening in the closed position when the opening is secured and opens when the door or window is opened. Wireless systems, such as that described in U.S. Pat. No. 4,367,458 (Hackett), assigned to the same assignee as the present invention, must overcome problems caused by interference from other communication systems and multipath. Ultrasonic systems, in particular, are confronted with acoustical interference and are restricted in speed by the relatively slow speed of sound. A wired alarm system avoids these problems. Furthermore, many facilities are already wired, facilitating installation of a wired alarm system, such as the present invention.

It is a common practice in wired alarm systems to connect the switch contacts at the openings in series so that if one or more of the contacts opens, the circuit is broken. The interruption in the current, causes an alarm. Also, an alarm would result if the interconnecting wire is cut.

Prior to arming such an alarm system, all the openings must be secured. If an attempt is made to arm the system while a window or door is open, an immediate alarm would result. Usually the system will have an indicator to inform the user that one or more of the openings has not been secured. If that is the case, the alarm user would have to search the premises to find which of the openings are not secured. In a large system this can be a time consuming task.

A more serious problem encountered by users of alarm systems occurs when there is a false alarm due to an intermittent contact. It is almost impossible to find the faulty contact until its performance deteriorates to the point where it has become continuous. By then the aggravation has often reached the point where the user has asked the alarm company to remove the system.

To minimize this problem, systems exist which have been arranged in a zoned system, the contacts are grouped together, each group returning through a separate input to the control panel via its own separate wire.

If an opening has not been secured or there is an intermittent contact, the search can be confined to the particular zone. The ideal system would have one zone per contact. There are times when this could be done, but in general it would be very expensive since it would require a wire to be run from each protected point back to an input of the control. Besides requiring a large amount of wire, one input to the control would be required for each monitored opening.

SUMMARY OF THE INVENTION

The present invention is directed to a multiplexed alarm system which can individually monitor the status of a plurality of contacts wired along a single pair of wires to a single input in the control unit. A microcomputer in the control unit may be used to store and display the information obtained from the transponders at each contact. This advantageously enables the user of this system to determine which contacts are presently open and which contacts caused an alarm even though those contacts may be secure at present.

The present invention accomplishes its multiplexing along a single line by sending out a synchronizing signal to all of the transponders on the line. Each transponder is assigned its own particular time delay before responding to the control unit. The control unit will expect an acknowledgement signal from each transponder within an allotted time slot at its assigned predetermined time delay. If an acknowledgement signal is not received during a time slot, the control unit would indicate which contact is not secure according to the time delay of the slot which lacked an acknowledgement signal. Thus, using the present invention a single pair of wires may be used for a plurality of contacts and the control unit may still provide an indication of the individual contact which is open.

DETAILED DESCRIPTION OF THE PREFERRED EMBODIMENT

The multiplexed alarm system of the present invention includes a control unit operated by a microcomputer 10 and a plurality of transponders 20 connected in parallel to constitute a single zone of transponders. It is possible to expand the system of the present invention to operate a plurality of zones of parallel connected transponders 20 with a single microcomputer 10. The control unit supplies the transponders 20 in a zone with power, a DC voltage and a synchronizing signal over a single pair of wires. A transponder 20 is located at each protected opening where it connects to a contact 30. The contact 30 is opened whenever the protected opening, usually a window or door, is likewise opened. Each transponder 20 is encoded with a unique identity number, corresponding to a particular predetermined time delay.

Figure 1:
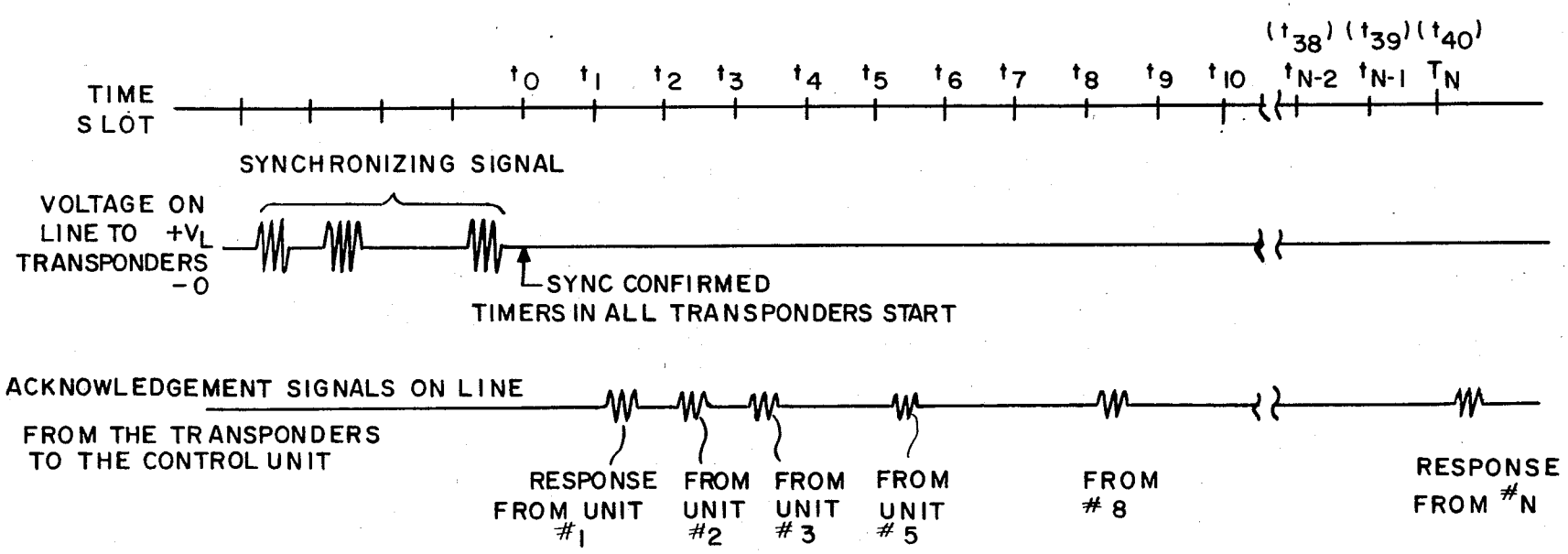
FIG. 1 is a diagrammatic representation of the signals sent out by the control unit and the transponders as a function of time.

The communication between the control unit and the transponders 20 is accomplished in a time division multiplexing format. Referring now to FIG. 1, the control unit initiates a scan of the transponders by sending a synchronizing signal over the pair of wires. The synchronizing signal starts a programmable timer in each of transponders 20. The synchronizing signal is a sequence of tone bursts. The identity number programmed into each transponder 20 establishes the time slot in which it is to respond to the control unit. If the corresponding contact 30 is closed, the transponder 20 will respond with an acknowledgement signal after its preprogrammed time delay. If the contact 30 is open, the transponder will not respond. The control unit will interpret the lack of an expected response as an open contact or a broken line.

The control unit may send alternative synchronizing signals to check upon the status of other inputs that might be added to the circuitry. One such signal that is used in the preferred embodiment is a troubleshooting signal. This signal checks whether each of the transponders 20 is functioning and that the line is intact. The troubleshooting signal is useful while the system is disarmed, since the user can be informed of a malfunction before closing the premises and arming the alarm system. The troubleshooting signal initiates a scan which causes each of the transponders 20 to respond regardless of the state of the contact 30 connected to it. Thus, even if a door is left open during the day while the system is disarmed, a troubleshooting scan would continuously verify that the transponder is functioning and is properly connected to the system.

The control unit expects a response from each transponder 20 that is within the system. Any break in a wire or malfunction of a transponder 20 will be noticed immediately. There are also blank periods during which responses are not expected. The responses during a typical scan in which units 1-5, 8 and N are on the line, are shown in FIG. 1 where responses were properly received from units 1,2,3,5,8 and N. There was no response from unit 4. If this is a standard contact status scan, then unit 4 is logged as an open contact. If this is a troubleshooting scan, unit 4 would be logged as a nonfunctioning transponder. In the example shown in FIG. 1, units 6, 7 and 9 through N−1 are not being used, so the control unit is not expecting responses during their respective time periods. If a signal was received when not expected or in a blank period between signals, an alarm would result. This prevents someone from connecting a signal generator to the line and feeding the control unit with a continuous response tone in the hope of supplementing any missing responses when an opening is breached.

Figure 2:
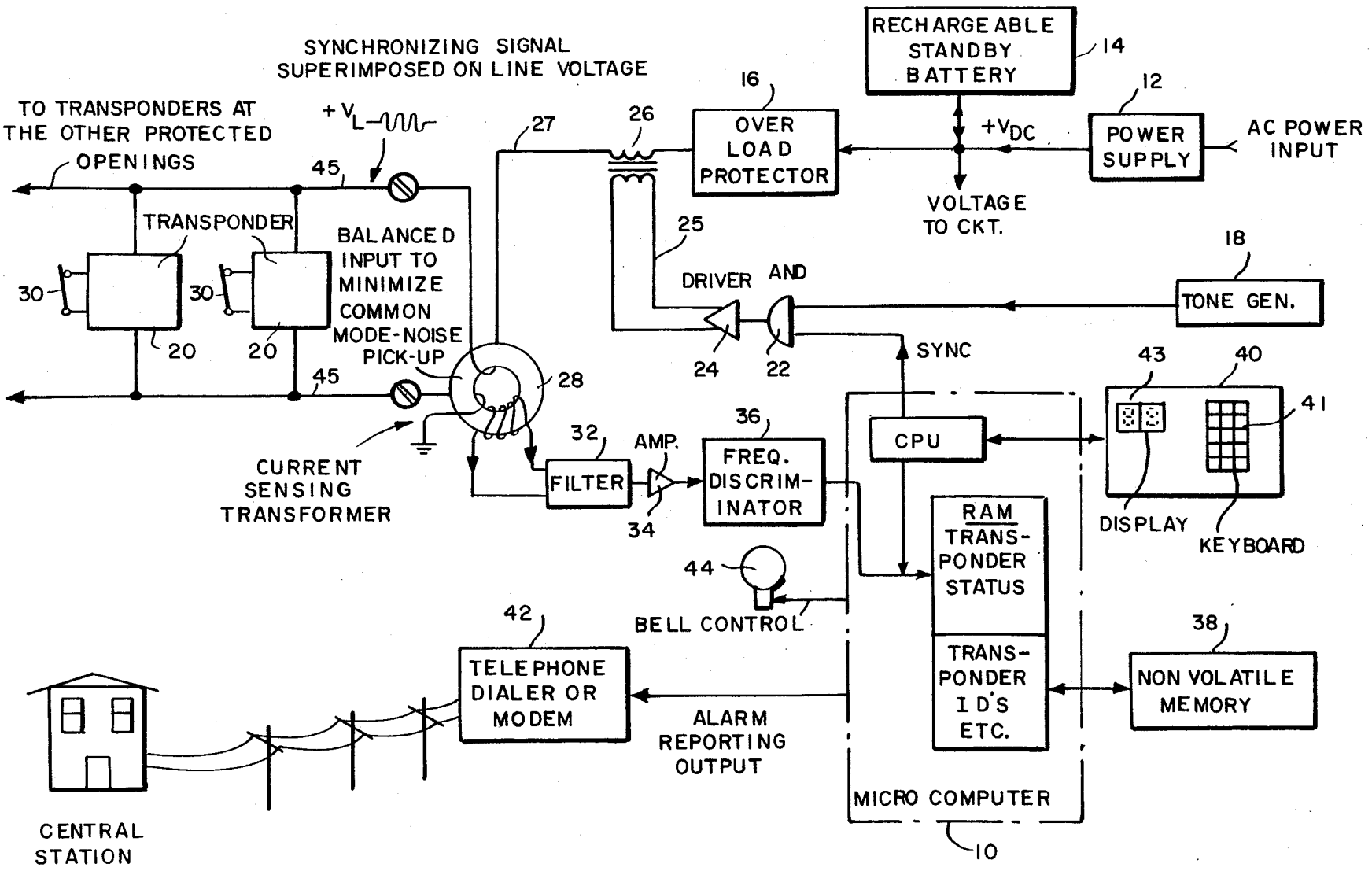
FIG. 2 is a diagrammatic representation of the control unit of the present invention.

Referring now to FIG. 2, a diagram of the control unit is shown. A power supply 12 supplies a DC voltage, preferably 12 to 15 volts, to the internal circuitry of the control unit as well as to the line connected to the transponders 20. A rechargeable battery 14 is provided in the event that the power supply should be disabled or there is a power outage. An overload protector 16 is used to prevent any damage to the system that might be caused if the wires to the transponders 20 were shorted.

To maximize the performance from the system in the presence of noise, tone signaling is used. Pulse signaling has been used in multiplexing applications in the past, but these signals are vulnerable to impulse noise. Narrow band tone signaling is substantially immune from noise since any noise energy would have to be confined within the narrow band of the tone to have an adverse effect.

A tone generator 18 produces a signaling frequency, typically 6 kilohertz. The microcomputer 10 generates a synchronizing pattern to key the tone on and off in bursts. The synchronizing pattern from the microcomputer and the tone from the generator 18 are combined in an AND gate 22 to produce a synchronizing signal. As shown in FIG. 1, a driver 24 then feeds the primary of transformer 26 via line 25. The secondary of transformer 26 is connected in series with line 27 so that the tone bursts are superimposed on the DC power supply voltage.

The transponders respond to the synchronizing signal with an AC current acknowledgement signal. Its frequency is typically the same as that used for the synchronizing signal, 6 kilohertz. The line from the transponders is terminated at the control unit in a low impedance. The AC current from the transponders is sensed by a balanced current transformer 28. The transformer is connected in the balanced configuration to advantageously attenuate the amount of common mode noise which is picked up on the pair of wires before the signal is presented to the discriminator.

The acknowledgement signal from the sense winding of the transformer 28 is filtered in filter 32 and amplified by amplifier 34. The resulting signal is then fed to a frequency discriminator 36 to determine if the receive signal is of the correct frequency. While a correct frequency is being received, the frequency discriminator 36 feeds pulses to the input of the microcomputer 10. The microcomputer 10 determines which transponder is responding by checking the time slot in which the response is occuring. This information is routed into the appropriate memory location for that transponder in its internal ramdom access memory, RAM.

Alarms can be fed to a central station via a telephone dialer or modem 42 and/or fed to a local bell 44.

A user of this system interacts through a console 40 including a keyboard 41 and a display 43. The keyboard 41 is used to program the system. The information input into the system would include which transponder identity numbers are being used, the length of entry/exit delay times, and the length of time the bell is allowed to ring. The information is stored in the non-volatile memory 38 so that it will not be lost after a long power outage if the standby battery 14 should run down.

The system shown in FIG. 2 indicates a single zone of transponders. The number of transponders which may be connected in a single zone are only limited by the number of time slots which are made available by the programmed microcomputer 10. In this example, FIG. 1 shows that the time slots are limited to 40. The system of the present invention may be expanded to include additional wire runs, current transformers 28 and frequency discriminators 36 to provide additional zones of transponders. A single microcomputer 10 can be used to process all the signals providing that it has a large enough memory capacity.

Figure 3:
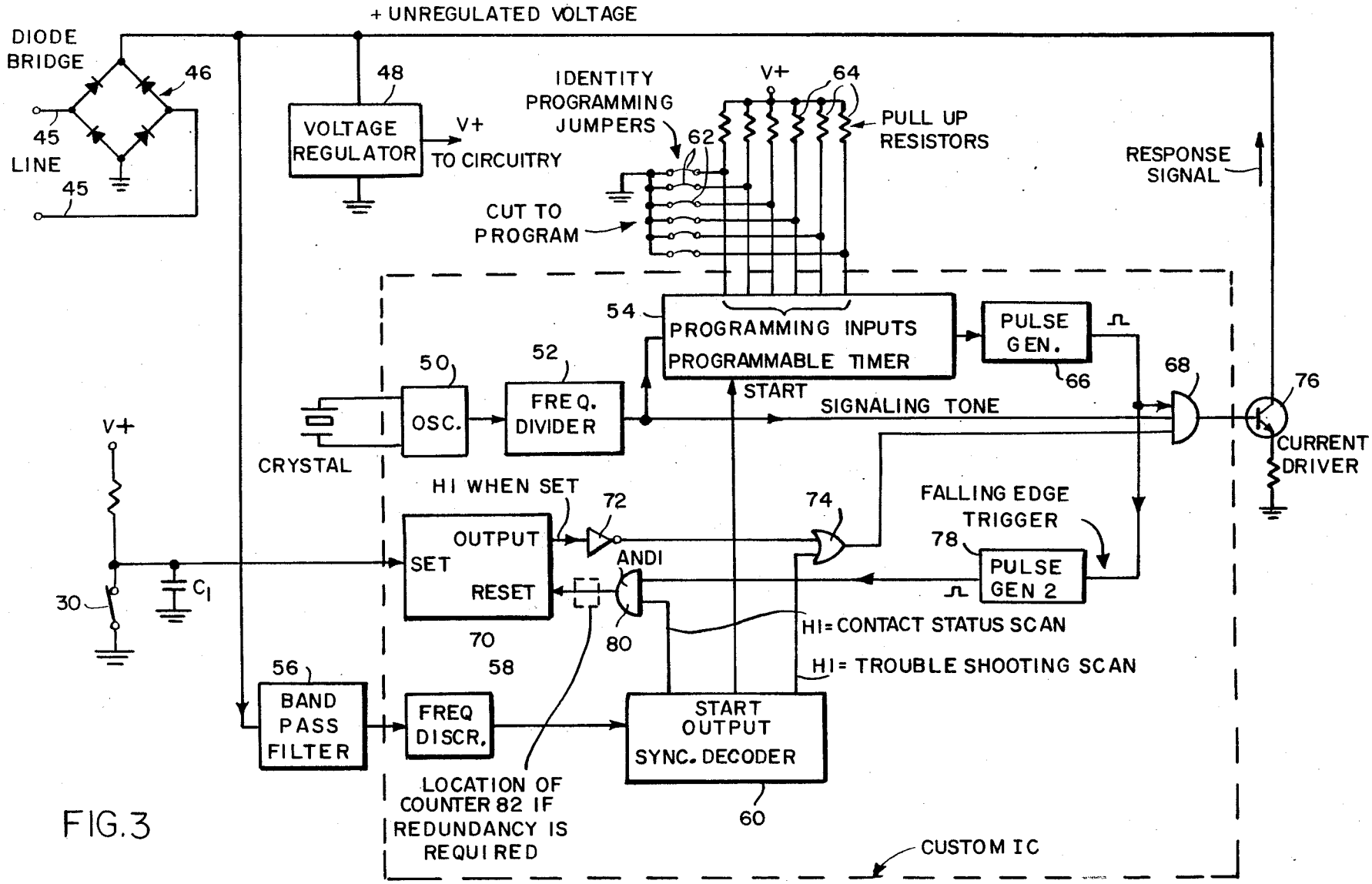
FIG. 3 is a diagrammatic representation of a transponder for use in the present invention.

Referring now to FIG. 3, a transponder 20 will be described. The transponder 20 derives its power from the DC voltage on the line 45. A bridge rectifier 46 allows either polarity from the line 45 to be used. This simplifies installation since the installer need not concern himself with the polarity. The bridge 46 is used only for correcting the polarity of the input power not for rectifying the signal tone. Because of the DC voltage the tone appears intact at the output of the bridge 46.

A voltage regulator 48 regulates the voltage down to a low voltage to operate the internal circuitry of the transponder 20. This allows the line voltage to vary widely due to line loss and a discharging battery during standby without affecting the operation of the circuitry. A typical line voltage is 12 volts DC and a typical voltage from the regulator 48 is 4 volts DC.

A crystal oscillator 50 is connected to a frequency divider 52 to produce the signalling frequency, 6 kilohertz. Using a divider 52 reduces the cost of the frequency generators since high frequency crystals are much less expensive than those crystals producing frequencies as low as 6 kilohertz. The divider 52 is also used to drive a programmable timer 54.

The operation of a transponder 20 begins in the standby mode. In this mode, the transponder 20 is awaiting a synchronizing signal from the control. The received signal is band limited by a filter 56. This minimizes out of band noise components. The received signal is then fed to a frequency discriminator 58 to determine if the frequency of each synchronizing code burst is correct. While the correct frequency is being received, the discriminator 58 feeds a series of pulses to a synchronizing decoder 60. If the received signal is identified as a correct signal, the programmable timer 54 is started, establishing $t_O$ of FIG. 1. The timers 54 in each of the transponders will start at the same time in response to this synchronizing signal.

Each of the transponders has a different identity which determines a different predetermined time delay before its sends its acknowledgement signal. The identity is programmed by cutting appropriate encoding jumpers 62. A jumper 62 holds the corresponding programming input to the timer 54 low. Cutting a jumper releases that input allowing it to rise to the supply voltage via its pullup resistor 64. The combination of cut and intact jumpers determines a binary code identifying the time delay for each particular transponder 20. The programmable timer 54 is connected to a pulse generator. The generator 66 applies a pulse during the appropriate time slot. The pulse is sent through an AND gate 68. Whether an acknowledgement signal will be sent out during the pulse is determined by the status of the contact switch 30 and the type of synchronizing signal received.

An alarm latch 70 is provided to receive the status information from the contact switch 30. If the contact 30 remains closed, the alarm latch output remains low. Under this condition, the transponder 20 responds during its predetermined time slot. The low output from the alarm latch is inverted in inverter 72 and fed through the OR gate 74. When the pulse generator 66 applies a pulse, the signalling tone from frequency divider 52 is gated through the AND gate 68 since the OR gate 74 is supplying a high signal. A current driver 76 then places the signal current onto the line 45 at tone frequency.

If the contact is open, the voltage to the set input of the alarm latch 70 rises. This input is filtered by a capacitor C1 so spurious noise will not affect the latch. The response speed is adjustable by the selection of an appropriate capacitor. When the alarm latch is set, the transponder 20 is prevented from responding to a contact status synchronizing code. The inverter 72 sends a low input to the OR gate 74 which will also send a low signal since this is a contact status scan rather than a trouble checking scan. The low input to the AND gate 68 prevents a signal from being sent during the time slot indicated by pulse generator 66. The falling edge from the pulse generator 66 triggers pulse generator 78. Pulse generator 78 supplies a reset pulse to the alarm latch 70 after the time slot in which it would have responded. Since a contact status scan is still in progress, the output from the synchronizing decoder 60 into AND gate 80 is still high, allowing the pulse from pulse generator 78 to pass through. This resets the alarm latch 70 if the contact is closed. If the contact remains open, the alarm latch cannot be reset and the alarm latch will continue to cause missing responses to contact status synchronizing codes.

It may be desirable to miss at least a certain number of responses any time the contact 30 is open. A redundancy counter 82 may be inserted in the reset line. This would prevent resetting latch 70 until the predetermined number of responses has been missed. Thus, any momentary opening of the contact 30 would cause the predetermined number of responses to be missed.

A troubleshooting synchronizing code causes a response regardless of the status of the alarm latch 70. If the alarm latch is set because of an open contact prior to a troubleshooting response, the latch remains set after that response. The contact status output from the synchronizing decoder 60 is low at this time thereby preventing the reset pulse from passing through AND gate 80. Therefore, if the latch has been set it will remain in that state to inhibit a response during the next contact status scan. Thus, according to the present invention a momentary opening of the contact will be detected even though it occurs in between contact status scans.

During a troubleshooting scan, the output from the synchronizing decoder 60 into the OR gate 74 is high enabling AND gate 68 to pass the signalling tone during the appropriate time slot regardless of the status of latch 70. A transponder could be provided which would make other responses by adding the necessary logic to the decoder 60 for the different synchronizing codes and appropriately latch the status for these additional inputs.

In the presently preferred embodiment, the circuitry contained within the broken line shown in FIG. 3 is incorporated into a single custom integrated circuit. This reduces the size, cost and power consumption of the circuitry. According to the presently preferred embodiment the time slot duration is sixty milliseconds and the number of time slots for each zone of transponders is forty. In accordance with this embodiment, each scan will last approximately three seconds. The time in each scan which is not attributed to time slots is provided for the synchronizing codes and for dead time at the end of each scan.

A user operates the system through the console 40. The console 40 contains LED's which display the status of the power supply, the standby battery and an indication of whether there has been an alarm. A two digit display 43 is provided for reading out the identity numbers of the protected points. An LED on the console 40 indicates whether one or more openings is not secured. Prior to arming the system, if that LED is on, the user would press the appropriate key or keys to request the number of the opening having an open switch. If there is more than one, the identity numbers of the transponders will be displayed in sequence. The user may then go to these locations and secure them. This will turn off the open LED if all of the openings have been secured. Then the user may enter the arming code setting the system. This erases the alarm data memory. A predetermined time delay which was entered into the console is provided for the user to exit through a designated door. If the user exits after the predetermined time or goes through an opening that is not designated as the exit, an alarm would result.

If the user ignores the open LED and attempts to arm the system anyway, a warning tone would sound indicating that arming has been refused. The identity numbers of the unsecured openings would be displayed in sequence. The openings must be secured before arming is possible.

When the user enters in the morning he must use a designated entry/exit door. When the door opens, the entry timer starts. The user must enter the disarming code into the console 40 before the time expires or an alarm would result. When the user and the police arrive in response to a break-in, once again, the transponders in the entry area will not be read into the memory until the entry delay time has expired. Within that time the user or the police must disarm the system by pressing the appropriate buttons on the console. This also stops the acquisition of additional alarm data so that the break-in can be investigated without adding spurious data to the sequence of openings stored in memory. The system may be interrrogated to obtain a display of the opening(s) which caused the alarm. The sequence of openings prior to disarming the system remains in the memory of the system while the break-in is being investigated. In this manner, the police or user can recheck the identity of the causes of the alarm later, if they didn't have time when they arrived. While the alarm data is stored in the console, the system may not be armed. To allow the system to operate normally, a code must be entered into the console. Preferably, this code is known only to the alarm company thereby preventing the user from inadvertently discarding the identity of the transponder which caused the alarm. When an alarm is answered the entry of the user and police into the premises will not be recorded if the system is disarmed within the entry delay period.

Of course, it should be understood that various changes and modifications to the preferred embodiment described above will be apparent to those skilled in the art. For example, an equivalent transponder could be designed in which an open contact causes a low signal to be latched rather than a high signal. Also, a single zone of transponders may include several branches all connected in parallel off a single pair of wires to the transformer 28. These and other changes can be made without departing from the spirit and scope of the invention and without diminishing its attendant advantages. It is therefore intended that such changes and modifications be covered by the following claims.

We claim:

1. A multiplexed alarm system for monitoring a plurality of openings comprising:

a plurality of contact means each connected with one of said openings, for indicating whether its respective opening is open or secured;

a zone containing a plurality of transponders connected in parallel by a pair of wires, each transponder being connected with one of said contact means and including:

means for receiving a synchronizing tone signal over said pair or wires;

a bandpass filter for said tone signal;

a synchronizing signal decoder responsive to tone signals from said bandpass filter;

a precision oscillator;

a programmable counter coupled to said oscillator and said decoder to count oscillations from said oscillator upon receipt of a decoded synchronizing signal;

means for selectively programming said counter to produce an output at a predetermined count;

means for generating an acknowledgment signal within a time slot after receiving said output of said counter;

a current driver connected to said acknowledgment signal generating means for sending an acknowledgment signal on said pair of wires, said current driver having a high impedance to help minimize the loading on said pair of wires by said plurality of transponders; and means for preventing an acknowledgment signal from being sent if the contact connected to the transponder indicates that an opening is open;

control means including means for sending said tone synchronizing signal to said zone of transponders and low impedance means connected to said pair of wires for receiving acknowledgment signals from said zone, said control means including means for causing an alarm if an acknowledgment signal is not received within the time slot corresponding to a particular transponder in said zone; and display means connected with said control means for providing an identification of the transponder(s) which caused an alarm.

2. The alarm system of claim 1 wherein said control means includes means for causing an alarm if an acknowledgment signal is received at a time other than a time slot corresponding to a transponder in said zone.

3. The alarm system of claim 1 wherein said control means includes means for sending a troubleshooting synchronizing signal and each of said transponders sends an acknowledgment signal during the time slot corresponding to said transponder, regardless of the status of its respective contact.

4. The alarm system of claim 1 wherein each of said transponders includes latch means for storing a high signal if the respective contact is opened and means for resetting said latch means at the end of the time slot corresponding to said transponder if the respective contact has been closed.

5. The alarm system of claim 4, wherein each of said transponders further comprise redundancy counter means, connected between said reset means and said latch means, for preventing said latch means from being reset until a predetermined number of synchronizing signals are received after said latch means has been set to a high signal.

6. The alarm system of claim 1 wherein said memory means retains data identifying each transponder that fails to respond to a synchronizing signal.

7. The alarm system of claim 1 wherein one or more of said transponders is a designated exit transponder and said control means includes timer means for counting predetermined time period after said alarm system is armed so that an alarm is not caused if one of said exit transponders fails to respond to a synchronizing signal during said predetermined time period.

8. The alarm system of claim 1 wherein one or more of said transponders is designated an entry transponder and said control means includes timer means for counting a predetermined time period after one of said entry transponders fails to respond to a synchronizing signal so that an alarm is caused only if said alarm system is not disarmed before the end of said predetermined time period.

9. The alarm system of claim 1 wherein each of said transponders includes oscillator means for producing a narrow band tone signal frequency to be used to generate said acknowledgement signal.

10. The alarm system of claim 1 wherein said low impedance means for receiving acknowledgment signals comprises a balanced current transformer connected between said zone of transponders and said control means for attenuating the amount of common mode noise which is picked up by the pair of wires.

11. The alarm system of claim 1 wherein said display means further includes means for displaying which openings are presently open.

12. A multiplexed alarm system for monitoring a plurality of openings comprising:

a plurality of contact means each connected with one of said openings, for indicating whether its respective opening is open or secured;

a plurality of zones, each containing a plurality of transponders connected in parallel by a pair of wires, each transponder being connected with one of said contact means and including:

means for receiving a synchronizing tone signal over said pair of wires;

a precision oscillator;

a programmable counter coupled to said oscillator;

means responsive to receipt of said synchronizing tone signal for initiating a count in said counter;

means for selectively programming said counter to produce an output at a predetermined count;

means for generating an acknowledgment signal within a time slot corresponding to the predetermined count of a particular transponder following the receipt of a synchronizing signal;

a current driver connected to said acknowledgment signal generating means for sending an acknowledgment signal on said pair of wires, said current driver having a high impedance to help minimize the loading on said pair of wires by said plurality of transponders; and means for preventing an acknowledgment signal from being sent if the contact connected to the transponder indicates that an opening is open;

control means including means for sending a synchronizing signal to each of said zones of transponders and low impedance means connected to the pair of wires in each of said zones for receiving acknowledgment signals from each of said zones, said control means including means for causing an alarm if an acknowledgment signal is not received within the time slot corresponding to a particular transponder in one of said zones; and display means connected with said control means for providing an identification of the transponder(s) which caused an alarm.

13. The alarm system of claim 12 wherein said control means includes means for causing an alarm if an acknowledgment signal is received at a time other than a time slot corresponding to a transponder in said zone.

14. The alarm system of claim 12 wherein said low impedance means for receiving acknowledgment signals comprises a plurality of balanced current transformers, each connected between one of said zones of transponders and said control means for attenuating the amount of common mode noise picked up by the respective pair of wires.

15. A multiplexing method for wired alarm systems comprising:

sending a synchronizing tone signal;

receiving said synchronizing tone signal in a plurality of transponders wired in parallel each connected to one of a plurality of contacts which indicate whether an opening is open or secured;

counting a precision frequency in each of said transponders from the receipt of said synchronizing signal up to a preprogrammed count corresponding to the particular transponder;

storing a high signal in a transponder if its respective contact indicates an opening that is open;

resetting the high signal to a low signal at the end of a time slot following the completion of the preprogrammed count corresponding to the particular transponder if its respective contact is then secured;

each of said transponders sending an acknowledgment signal upon completion of the preprogrammed count if it has a low signal stored; and causing an alarm if a transponder fails to send an acknowledgment signal at its preprogrammed count.

16. The multiplexing method of claim 15 further comprising:

displaying an identification of the transponder(s) which caused an alarm.

17. The multiplexing method of claim 15 further comprising:

causing an alarm if an acknowledgment signal is sensed at a time other than the end of a preprogrammed time delay corresponding to one of said transponders.

18. The multiplexing method of claim 15 further comprising:

storing the identity of each transponder that fails to respond to a synchronizing signal.

19. The multiplexing method of claim 15 further comprising:

counting a predetermined amount of time after said alarm system is armed so that an alarm is not caused if a designated exit transponder fails to respond to a synchronizing signal during said predetermined amount of time.

20. The multiplexing method of claim 15 further comprising:

counting a predetermined amount of time after a designated entry transponder fails to respond to a synchronizing signal so that an alarm is caused only if said alarm system is not disarmed before the end of said predetermined amount of time.

21. The multiplexing method of claim 15 wherein said synchronizing signal is a sequence of tone bursts.

22. The multiplexing method of claim 15 wherein said acknowledgment signals comprise a sequence of tone bursts in the respective time slots of the transponders.

23. A multiplexed alarm system for monitoring a plurality of openings comprising:

a plurality of contact means each connected with one of said openings, for indicating whether its respective opening is open or secured;

a zone containing a plurality of transponders connected in parallel by a pair of wires, each transponder being connected with one of said contact means and including:

means for receiving a synchronizing tone signal over said pair of wires;

a bandpass filter for said tone signals;

a synchronizing signal decoder responsive to tone signals from said bandpass filter and including means for indicating receipt of a troubleshooting synchronizing signal;

a precision oscillator;

a programmable counter coupled to said oscillator and said decoder to count oscillations from said oscillator upon receipt of a decoded synchronizing signal;

means for selectively programming said counter to produce an output at a predetermined count;

means for sending an acknowledgment signal on said pair of wires within a time slot after receiving said output of said counter; and means for preventing an acknowledgment signal from being sent if the contact connected to the transponder indicates that an opening is open unless said signal decoder indicates receipt of a troubleshooting synchronizing signal;

control means for sending said tone synchronizing signal to said zone of transponders and for receiving acknowledgment signals from said zone, said control means including means for causing an alarm if an acknowledgment signal is not received within the time slot corresponding to a particular transponder in said zone, said control means further including means for sending a troubleshooting synchronizing signal; and display means connected with said control means for providing an identification of the transponder(s) which caused an alarm.

24. A multiplexed alarm system for monitoring a plurality of openings comprising:

a plurality of contact means each connected with one of said openings, for indicating whether its respective opening is open or secured;

a zone containing a plurality of transponders connected in parallel by a pair of wires, each transponder being connected with one of said contact means and including:

means for receiving a synchronizing tone signal over said pair of wires;

a bandpass filter for said tone signal;

a synchronizing signal decoder responsive to tone tone signals from said bandpass filter;

a precision oscillator;

a programmable counter coupled to said oscillator and said decoder to count oscillations from said oscillator upon receipt of a decoded synchronizing signal;

means for selectively programming said counter to produce an output at a predetermined count;

means for sending an acknowledgment signal on said pair of wires within a time slot after receiving said output of said counter;

latch means for storing a high signal if the contact connected to said transponder is opened;

means for resetting said latch means after the time slot corresponding to said transponder if the contact connected to said transponder has been closed; and means for preventing an acknowledgment signal from begin sent if said latch means is storing a high signal;

control means for sending said tone synchronizing signal to said zone of transponders and for receiving acknowledgment signals from said zone, said control means including means for causing an alarm if an acknowledgment signal is not received within the time slot corresponding to a particular transponder in said zone; and display means connected with said control means for providing an identification of the transponder(s) which caused an alarm.

* * * * *